United States Patent [19]

Jonsson

[11] 4,065,938

[45] Jan. 3, 1978

[54] AIR-CONDITIONING APPARATUS WITH BOOSTER HEAT EXCHANGER

[75] Inventor: Kjartan A. Jonsson, Ballston Lake, N.Y.

[73] Assignee: Sun-Econ, Inc., Ballston Lake, N.Y.

[21] Appl. No.: 646,711

[22] Filed: Jan. 5, 1976

[51] Int. Cl.[2] ..... F25B 13/00

[52] U.S. Cl. ..... 62/160; 62/2; 62/238; 237/2 B

[58] Field of Search ..... 62/1, 2, 79, 160, 199, 62/198, 238; 237/1 A, 2 B; 165/29

[56] References Cited

U.S. PATENT DOCUMENTS

| | | | |
|---|---|---|---|
| 3,103,793 | 8/1963 | Kyle et al. | 62/160 |
| 3,563,304 | 2/1971 | McGrath | 165/29 |
| 3,777,508 | 12/1973 | Imabayashi et al. | 165/29 |
| 3,918,268 | 11/1975 | Nussbaum | 62/160 |
| 3,960,322 | 6/1976 | Ruff et al. | 62/2 |
| 4,012,920 | 3/1977 | Kirschbaum | 62/2 |

*Primary Examiner*—William E. Wayner
*Assistant Examiner*—Robert J. Charuat
*Attorney, Agent, or Firm*—Pollock, Vande Sande & Priddy

[57] ABSTRACT

An air-conditioning apparatus of the reversible heat pump type includes a booster heat exchanger for the refrigerant gas. The booster heat exchanger receives refrigerant from or in parallel with the evaporator or outdoor coil during the heating mode of operation and adds additional superheat to the gas by exposing it to convective or radiant ambient heat, or both. A temperature sensitive valve controls flow through the booster heat exchanger to the compressor of the apparatus, to prevent compressor damage due to excessive suction temperature. The booster is automatically shunted out of the refrigerant flow line when the apparatus is operating in the cooling mode, to control the load on the compressor and ensure proper operation during cooling. Substantial increases in operating efficiency are obtained.

6 Claims, 6 Drawing Figures

AIR-CONDITIONING APPARATUS WITH BOOSTER HEAT EXCHANGER

BACKGROUND OF THE INVENTION

More than 20 years have passed since air-conditioning manufacturers first began marketing year-round electric heating and cooling systems for home and commercial use, under the now-familiar name of heat pumps. The first heat pump units were essentially conventional air-conditioning units which had been modified for reverse operation to pump heat into the building in winter and out of the building in summer. After years of development, heat pump units are now available which are reliable and effective over a relatively wide range of outdoor ambient temperatures, down to about 25° to 35° F outdoor ambient temperature. However, even with higher fossil fuel prices today, presently available heat pump units are usually not the most economically efficient means for residential and commercial heating. This is particularly so for the lower outdoor ambient temperatures in the 10° to 35° range where presently available heat pump efficiency is at its lowest and heating demand is at its highest. Supplemental conventional heat sources are therefore required to meet normal heating demands at the lower outdoor ambient temperatures.

Thus, a need exists for a heat pump apparatus which will deliver more heat to a building or other user for a given input power, than has heretofore been found to be practical. Such an apparatus is needed which will increase heat pump efficiency in the heating mode without affecting it in the cooling mode. Moreover, for simplicity and economy, a heat pump is needed which does not require supplemental heating until very low ambient temperatures are reached; say, below 25° F.

OBJECTS OF THE INVENTION

An object of the invention is to provide a heat pump air-conditioning apparatus which will operate satisfactorily without the need for supplemental heating at ambient temperatures substantially lower than possible with present commercially available units.

Another object of the invention is to provide an adjunct for existing heat pump apparatus in the form of a booster heat exchanger which will facilitate modification of existing equipment to achieve superior performance at low ambient temperatures.

A further object of the invention is to provide improved performance in the heating mode of operation of the air-conditioning apparatus, without diminishing the efficiency and reliability of the apparatus in the cooling mode.

Still another object of the invention is to provide a heat pump apparatus with a booster heat exchanger, in which flow through the booster heat exchanger is controlled as a function of the inlet temperature to the compressor, to prevent compressor damage during periods of high heat input from the booster heat exchanger.

Yet another object of the invention is to provide a heat pump apparatus with a booster heat exchanger which transmits ambient radiant or convective heat, or both, to the apparatus to improve performance in the heating mode.

A still further object of the invention is to provide a heat pump apparatus with a booster heat exchanger in which the booster heat exchanger can be removed from the refrigerant circuit in the cooling mode, thereby balancing compressor loading to ensure adequate performance in the cooling mode.

Another object of the invention is to provide a heat pump system with a booster heat exchanger, including means for defrosting said booster heat exchanger, by periodically reversing refrigerant flow.

A further object of the invention is to provide a heat pump apparatus with a booster heat exchanger, in which the booster heat exchanger is automatically removed from the circuit in the heating mode when the inlet temperature of the compressor reaches a predetermined limit.

These objects of the invention are given only by way of example. Thus, other objects or advantages inherently achieved by the invention may be discerned by those skilled in the art. Nevertheless, the scope of the invention is to be limited only by the appended claims.

SUMMARY OF THE INVENTION

The above objects and other advantages are achieved by the disclosed invention which comprises in one of its embodiments an indoor heat exchanger, a outdoor heat exchanger, a compressor, a control valve, the necessary piping to allow operation in both a heatng and a cooling mode, and the necessary control elements. An ambient atmosphere booster heat exchanger is provided which receives refrigerant from or in parallel with the outdoor heat exchanger in the heating mode, adds additional superheat to the refrigerant and delivers more highly superheated vapors to the compressor inlet. To prevent damage to the compressor, means are provided for controlling the compressor inlet temperature within preselected limits.

In some embodiments of the invention, the booster heat exchanger may be connected with a further heat exchanger located in a heat storage area such as a large volume of water or a buried location in the ground. By this means, excess heat may be stored until needed to satisfy demand at times when ambient atmosphere heat input is small.

Since the booster heat exchanger is required only during the heating mode of the apparatus, valving is provided to bypass it when the apparatus is operating in the cooling mode. This balances the load on the compressor and improves overall efficiency in the cooling mode. In the event that the outlet temperature from the booster heat exchanger approaches a maximum acceptable limit, the valving means of the invention is provided with a temperature sensor which actuates the valving means to bypass the booster heat exchanger.

During operation in the heating mode, condensation may accumulate as frost on the booster heat exchanger, thereby impairing its heat transfer capability. To combat this, the invention includes a control valve for the booster heat exchanger which permits flow of relatively warm refrigerant through the booster heat exchanger for a short time after the apparatus has been switched to the defrost mode. Once defrosting has been completed, the apparatus is shifted back to the heating mode.

The invention also includes within its scope the provision of an adjunct for existing heat pump systems which includes a booster heat exchanger, a temperature sensor for monitoring the refrigerant temperature at the compressor suction port and a control valve or valves responsive to the sensor and attached to the inlet of the booster heat exchange for regulating flow there through in the heating mode.

DETAILED DESCRIPTION OF THE PREFERRED EMBODIMENTS

Figure 1:
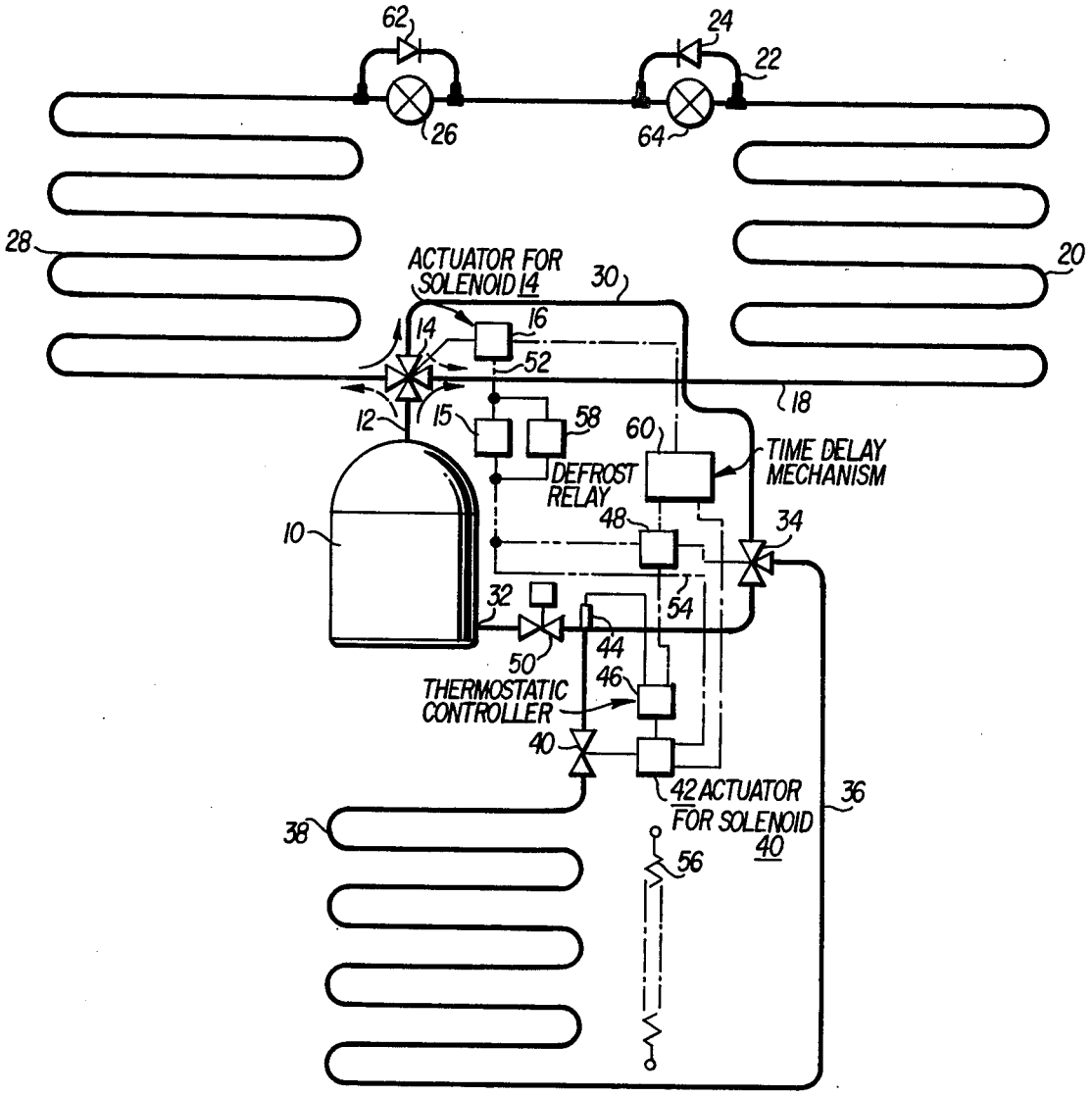
FIG. 1 shows the schematic diagram of a heat pump apparatus according to the invention in which the booster heat exchanger is located downstream of the reversing valve, in the heating mode.

There follows a detailed description of the preferred embodiments of the invention, reference being had to the drawings in which like reference numerals identify like elements of structure in each of the several Figures.

FIG. 1 shows a heat pump apparatus embodying the present invention. A compressor 10, which may be of the hermetically sealed variety as illustrated or other varieties commonly in use, serves to pump a refrigerant such as Freon-12 or ammonia through the apparatus. Heat pumps using other refrigerants are also usable for practicing the invention. The outlet tubing 12 from compressor 10 leads to one inlet port of a conventional four-way reversing valve 14, which directs the refrigerant in the direction indicated by the solid-line arrows when the apparatus is operating in the heating mode. Generally, reversing valve 14 is remotely actuated at a thermostat or similar conventional control device 15, via means such as solenoid actuator 16. As will be discussed subsequently, actuation of reversing valve 14 also controls the operation of the booster heat exchanger 38. From reversing valve 14, the high temperature (commonly 240° F), hig pressure (commonly 200 psig) refrigerant gas flows through tubing to an indoor heat exchanger coil 20, of conventional design, which acts as a condenser in the heating mode. Coil 20 is washed by forced-air flow from a fan or blower (not shown). As the refrigerant flows through coil 20, it gives up heat to the building interior or other environment to be heated, thereby dropping its temperature. The precise change in temperature will vary from heat pump to heat pump depending on the refrigerant temperature at the coil inlet, the size of coil 20, the air flow over it, the temperature in the building interior and related factors; however, a refrigerant temperature change of about 35° F is commonly experienced in coil 20.

From coil 20, the condensed refrigerant flows through by-pass tubing 22 and check valve 24 to thermostatic expansion valve 26. At the outlet of expansion valve 26, expansion of the refrigerant takes place as the refrigerant enters an outdoor heat exchanger coil 28, of conventional design, which acts as an evaporator in the heating mode. Coil 28 is also washed by forced air flow from a fan or blower (not shown). As the liquid refrigerant flows through coil 28, it absorbs heat from the outdoor ambient environment, thereby changing phase from liquid to saturated vapor. As more heat is absorbed, the temperature of the refrigerant is increased. As with coil 20, the precise change in temperature will vary; however, an outlet temperature for coil 28 of approximately 35° F would be typical. From coil 28, the saturated or slightly superheated vapor refrigerant flows through reversing valve 14 into tubing 30. In a conventional heat pump apparatus, the refrigerant would then be returned directly to the inlet or suction port 32 of compressor 10, wherein its temperature and pressure would be raised prior to repeating the cycle just described.

As the refrigerant moves through coil 28, the heat absorbed by it from the outdoor ambient environment causes different types of changes in the refrigerant. Initially, a certain amount of heat is absorbed to raise the temperature of the liquid refrigerant. Then an additional amount of heat is absorbed to change the refrigerant from the liquid to the vapor state without any associated increase in temperature. Finally, the remaining heat is absorbed to raise the temperature of the vapor slightly into the superheated region. In conventional heat pump systems, the degree of superheat added to the refrigerant vapor is typically relatively small, or non-existent, with the actual suction temperature of the compressor typically being about 35° F for a 45° F outdoor ambient temperatures. Since commonly used compressors characteristically have a maximum acceptable suction temperature of about 85° F, a considerably higher degree of superheat would be compatible with existing systems. Such higher superheat would ensure a higher net heat transfer to the building interior, provided an efficient way of providing such an additional superheat could be made available.

One possible approach to increasing the suction temperature of the compressor in the heating mode would be to simply enlarge outdoor coil 28 to enable it to absorb more heat from the air forced over it. This approach is unsatisfactory for a variety of reasons. First, a larger coil 28 would produce very large heat inputs at the higher ambient temperatures, with the result that the maximum acceptable suction temperature for compressor 10 would quickly be exceeded in the heating mode. Greater fan power would also be required to force air over the larger coil and the overall size of the device would increase considerably. Second, and more important, the apparatus would function poorly in the cooling mode if the capacity of coil 28 were increased to improve performance in the heating mode. This is because the condensing temperature and pressure would be reduced excessively; and, thereby the suction temperature and pressure would be reduced, due to the larger amount of heat rejected by coil 28 in the cooling mode. These reductions would lead to low flow rates through coil 20. With the commonly used hermetically sealed compressor and other compressor types which use refrigerant for cooling, the resultant low flow rates would result in high compressor motor temperatures with attendant motor damage or failure. Moreover, the temperature in coil 20 would drop so low that moisture from the building environment would condense and freeze thereon, with resultant dramatic loss in cooling capability and very possible damage to the compressor.

In accordance with the present invention, an ambient environment booster heat exchanger is provided which absorbs heat by convection or radiation, or both, from the outdoor ambient environment, without requiring the use of forced air to ensure adequate heat transfer. Referring again to FIG. 1, a three way solenoid valve 34 is connected in tubing 30. When valve 34 is actuated in the heating mode, refrigerant vapor flows from tubing 30 into tubing 36 which leads to booster heat exchanger 38. From booster heat exchanger 38, refrigerant flows on to inlet port 32 of compressor 10, via an open solenoid valve 40. Valve 40 is closed to prevent flow reversal in heat exchanger 38 in the cooling mode. An actuator 42 positions solenoid valve 40.

Booster heat exchanger 38 is a conventional refrigeration heat exchanger coil and typically comprises a coiled length of copper tubing having aluminum or copper heat exchange fins thereon. Booster heat exchanger 38 is positioned in the outdoor ambient environment of the building to be heated, in a position to receive maximum exposure to the sun's radiation and the ambient air during the winter months. For example, a southern exposure on a wall, roof or other support would suffice. With an ambient air temperature of about 45° F, a booster heat exchanger having an area of approximately 6 $ft^2$, will raise the inlet or suction temperature of compressor 10 to about 55° F, for an increase of about 20° F above the suction temperature of a typical conventional heat pump system, as previously mentioned. Accordingly, the heat available for transfer via coil 20 is increased dramatically. At higher outdoor ambient temperatures, the outlet temperature from booster heat exchanger 38 may approach or exceed the maximum permissible suction temperature for compressor 10. Under such conditions, booster heat exchanger 38 is no longer required for adequate heating. Accordingly, the invention includes a temperatures sensor 44 downstream of solenoid valve 40. When the temperature of the refrigerant reaches the maximum acceptable for compressor 10, say, 85° F, a thermostatic controller 46 is actuated by sensor 44 and closes solenoid valves 34 and 40 via actuators 48 and 42, respectively. When the temperature at sensor 44 has dropped to approximately the maximum outlet temperature to be expected from coil 28, say, 35° F, thermostatic controller 46 again opens valves 34 and 40 to place booster heat exchanger 38 back in the circuit. In some instances, the refrigerant pressure at suction port 32 may exceed the maximum acceptable for compressor 10 when booster heat exchanger 38 is operating. To prevent damage to the compressor in such a situation, a pressure controlled throttle valve 50, or crank case pressure regulator, preferably is provided.

Three-way solenoid valve 34 is operated by a solenoid actuator 48 which is energized by thermostat 15 simultaneously with solenoid actuator 16 and actuator 42, via conductors 52 and 54, when the apparatus is switched from the cooling to the heating mode. That is, flow through booster superheater 38 is prevented when the apparatus is placed in the cooling mode by thermostat 15, so that compressor motor temperature, refrigerant flow rate and refrigerant temperature do not depart from the levels required for satisfactory operation in the cooling mode.

During operation in the heating mode, the net effect of booster heat exchanger 38 is to maintain the suction temperature and pressure of compressor 10 at levels considerably higher than those achievable with conventional heat pumps. The result is that the refrigerant flow rate and the amount of heat in the refrigerant available for transfer from coil 20 to the building interior are greatly increased without affecting air blower power and without appreciably affecting compressor power required to operate the apparatus. Based on computerized synthesis, it is estimated that heat pumps incorporating the features of the present invention are from 40 to 55 percent more efficient than conventional heat pumps, in the heating mode.

Because heat pumps embodying this invention are more efficient than conventional apparatus, adequate heating is obtained when the outdoor ambient temperature is substantially lower than possible with conventional apparatus. Thus, depending on building heat losses, no supplemental heating will be required in most instances, down to an estimated temperature range of 10° to 20° F. Most conventional heat pumps require supplemental heating when operating below 35° F, a frequently occurring temperature in parts of the United States. In many areas of the United States, the improved heat pump according to this invention will be able to provide all the necessary heating capacity. However, even where supplemental heating is required for very low ambient temperatures, say, below 15° F, the inventive apparatus will provide more efficient heating over a wider range of ambient temperatures.

When the apparatus of FIG. 1 is operating in the heating mode, there is a tendency for moisture to condense and freeze on coil 28 and booster heat exchanger 38. Such "frosting" reduces the heat transfer capabilities of these elements; thus, it may be necessary to periodically switch the apparatus to a defrost mode in which warm refrigerant is run in reverse through coil 28 as in the usual cooling mode, and through booster heat exchanger 38. Ordinarily, about 5 minutes or less of such reversed operation is sufficient to defrost outdoor coil 28. But, the refrigerant is considerably cooler by the time it reaches booster heat exchanger 38, so that more time usually is required to defrost it particularly when the outdoor ambient temperature is very low, say, about 10° F. In recognition of this, this embodiment of the invention includes a resistance heater 56 which is activated by a defrost relay 58 to speed up defrosting of booster heat exchanger 38.

Since solenoid valves 34 and 40 are normally closed when flow is reversed by thermostat 15 for the cooling mode, defrost relay 58 holds both valves open when relay 58 switches reversing valve 14 for the defrost mode. Alternatively, defrost relay 58 can be replaced by a time delay mechanism 60, activated when reversing valve 14 is switched to the cooling mode to defrost, which maintains power to actuators 42 and 48 and energizes heater 56 for a period of time required to defrost booster heat exchanger 38. When coils 28 and 38 have been sufficiently defrosted, reversing valve 14 is switched back to the heating mode by defrost relay 58 or time delay mechanism 60, and operation continues. Those skilled in the art will appreciate that separate timing means (not shown) may be provided for cycling reversing valve 14 periodically to eliminate frost buildup on the outdoor heat exchangers.

When the apparatus is operated in the cooling mode, reversing valve 16 is switched by thermostat 15 to the dashed-line position shown in FIG. 1. Time delay mechanism 60, if used, holds three-way valve 34 open briefly, as previously discussed. Refrigerant vapor leaves compressor 10 and flows through outdoor coil 28 where heat is rejected to the ambient atmosphere, to condense the refrigerant. The refrigerant then flows through check valve 62 and thermostatic expansion valve 64. As the refrigerant flows through indoor coil 20, it absorbs heat from the indoor ambient atmosphere to give the desired cooling effect. The refrigerant then returns to compressor 10 via tubing 18, reversing valve 14 and throttle or crankcase pressure regulator valve 50 to complete the cycle. With booster heat exchanger 38 valved out of the circuit, the apparatus functions conventionally in the cooling mode, as will be understood by those skilled in the art.

Figure 2:
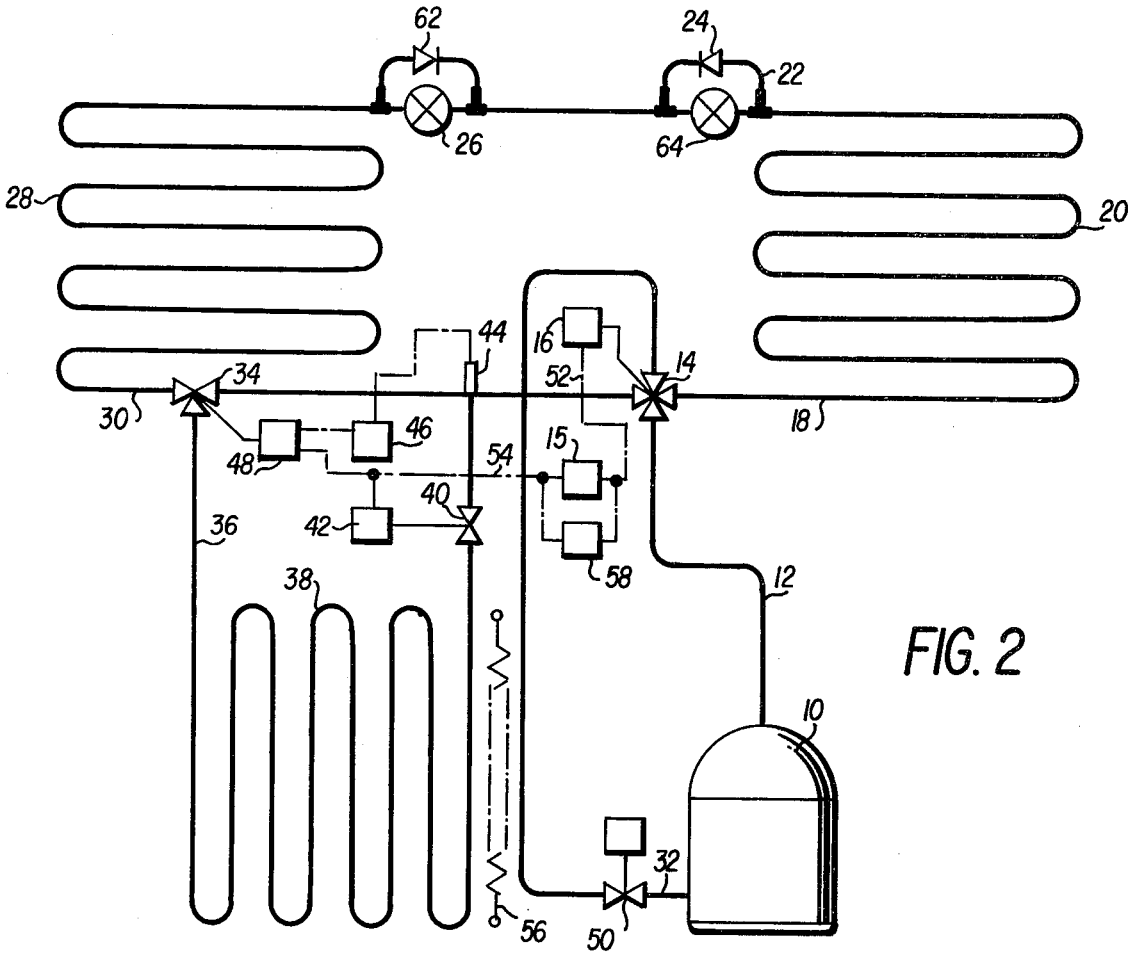
FIG. 2 shows a schematic diagram of a heat pump apparatus according to the invention in which the booster heat exchanger is located upstream of the reversing valve, in the heating mode.

FIG. 2 shows an alternative arrangement of the inventive apparatus in which the booster heat exchanger is connected on the upstream side or reversing valve 14, in the heating mode. Like numbered components function identically to those shown in FIG. 1. The operation of this embodiment of the invention is identical to that of the apparatus of FIG. 1, except that the direction of refrigerant flow through booster heat exchanger 38 is reversed during the defrost cycle. Although resistance heater 56 is illustrated in FIG. 2, it is not required in this embodiment since both booster heat exchanger 38 and coil 28 are on the outlet side of compressor 10, where the refrigerant temperature is sufficiently high to defrost both of these quickly.

Figure 3:
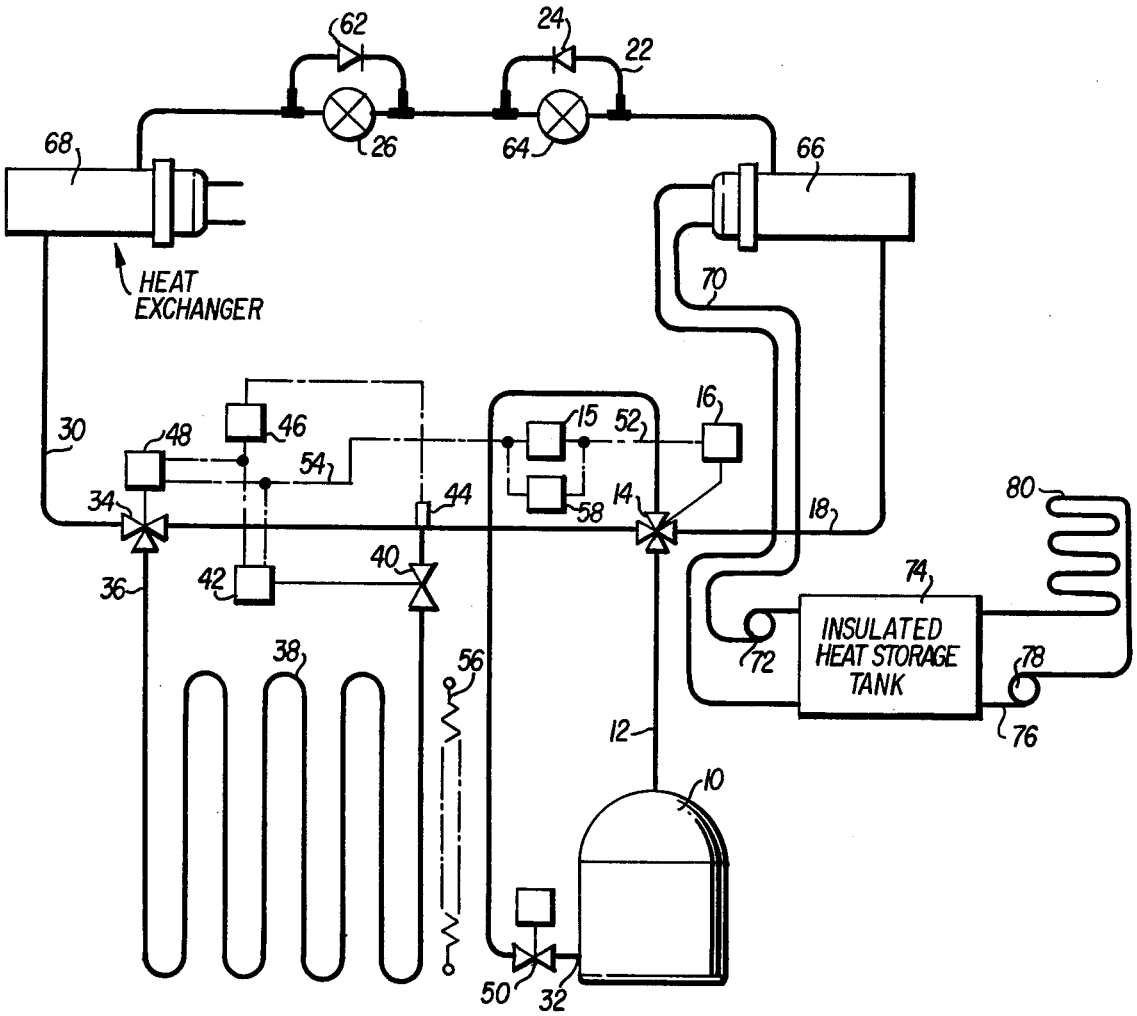
FIG. 3 shows a schematic diagram of a heat pump apparatus according to the invention, incorporating alternate forms of evaporator and condenser and a heat storage capability.

FIG. 3 shows a further embodiment of the invention which includes alternative types of heat exchangers and a heat storage capability. Like numbered components function identically to those shown in FIG. 2. In this embodiment, refrigerant-to-air heat exchange coils 20 and 28 have been replaced by refrigerant-to-liquid heat exchangers 66 and 68, respectively. In the heating or cooling mode, the hot or cold liquid outlets from heat exchanger 66 may be piped to suitable heat exchange coils (not shown) located in the building to be air-conditioned. However, it is preferred that the hot or cold liquid be withdrawn from heat exchanger 66 through conduit 70 by a pump 72, which delivers the hot or cold liquid to a large, insulated holding tank 74 located within or adjacent to the building. As heating or cooling is required within the building, hot or cold liquid is withdrawn from holding tank 74 through conduit 76 by a pump 78, which delivers it to local heat exchangers, such as indicated at 80, located throughout the building. In this embodiment, excess heating or cooling capacity can be stored in tank 74 during periods when the system output is more than adequate to meet the heating or cooling demands of the building, thereby increasing the overall efficiency of the apparatus.

In a similar fashion, heat exchanger 68 can be connected to any convenient chilled water supply (not shown) to provide adequate condensing in the cooling mode. The heat rejected in the cooling mode could be stored in an underground tank of water, a pebble bed, or in the ground itself and subsequently recovered during cold weather, as will be understood by those skilled in the art. Alternatively, heat exchanger 68 could be connected in parallel with a conventional refrigerant-to-air heat exchanger (not shown) and used to preheat domestic hot water.

Figure 4:
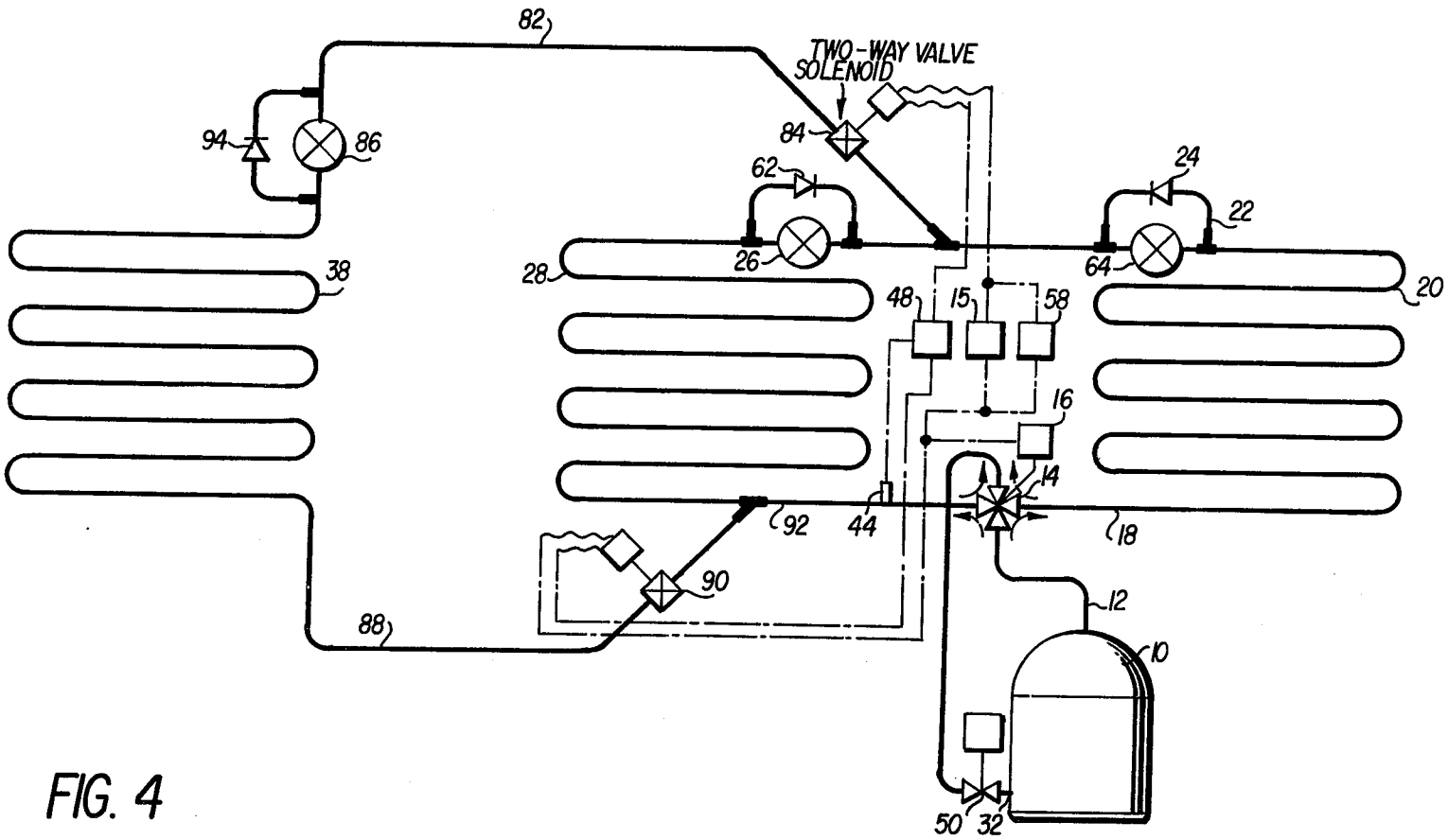
FIG. 4 shows a schematic diagram of a heat pump apparatus according to the invention in which the booster heat exchanger is operated in parallel with the outdoor evaporator, in the heating mode.

FIG. 4 shows another embodiment of the invention in which booster heat exchanger 38 is connected in parallel with coil 28. Whether the illustrated expansion valve 26 or a capillary is used for expansion of the refrigerant prior to its entering coil 28, it is preferred to connect branch tubing 82 from the liquid refrigerant line upstream of the valve or capillary, as illustrated, to allow optimum flow control through both heat exchangers. It is within the scope of the invention to connect tubing 82 downstream of expansion valve 26, however. Solenoid valve 84 is opened by thermostat 15 to permit flow through tubing 82 and, via parallel expansion valve 86, into booster heat exchanger 38. Tubing 88 directs flow from booster heat exchanger 38 via solenoid valve 90, also operated by thermostat 15, into tubing 92 where the refrigerant flows from both coil 28 and booster heat exchanger 38 combine before returning to compressor 10 via reversing valve 14. The additional heat absorbed by booster heat exchanger 38 raises the suction temperature of compressor 10 as in the embodiments of FIGS. 1 to 3, with attendant increase in efficiency. As in the previously described embodiments, temperature sensor 44 and controller 46 act to close valves 84 and 90 when the suction temperature of compressor 10 exceeds a predetermined limit.

In the defrost mode, relay 58 reverses valve 14 and holds valve 84 and 90 open to permit reverse flow through coil 28 and through valve 90, tubing 88, booster heat exchanger 38, check valve 94, tubing 82 and valve 84 until defrosting has been completed. Alternatively, a time delay mechanism similar to that discussed with respect to FIG. 1 could also be used.

Although the selection and sizing of actual components for practicing the invention are considered to be within the skill of one in the art once the teachings of this invention are known, the following information is presented for the major components of a nominal 2 ton capacity heat pump system embodying the principles of the invention:

Compressor: Approximately 24,000 Btu/hr. capacity.
Air Moving Device For Outdoor Coil: Approximately 2,400 cfm capacity fan.
Outdoor Fan Motor: Approximately ¼ H.P. 1080 r.p.m. electric motor.
Outdoor Heat Exchanger: Approximately 5.0 $ft^2$ surface coil, having copper tubes and aluminum fins.
Air Moving Device for Indoor Coil: Approximately 800 cfm fan.
Indoor Fan Motor: Approximately ⅓ H.P. 850 r.p.m. electric motor.
Indoor Heat Exchanger: Approximately 3.4 $ft^2$ surface area coil, having copper tubes and aluminum fins.
Booster Heat Exchanger: Approximately 6.0 $ft^2$ surface area coil, having copper tubes and aluminum fins.
Reversing Valve: Four-port, solenoid operated valve.
Throttling Valve: Crankcase pressure regulator valve.
Three-way Valve: Three-port, solenoid operated valve.
Interconnecting Tubing: Copper tubing gas line, ⅝ inch; liquid line, ⅜ inch.

Testing has been performed with a similar 1½ ton heat pump unit using components as described above and embodying the principles of the invention. Rated heat output was maintained down to an ambient temperature of about 17° F. Even at 7° F, the test apparatus was still delivering an efficient heat output. Based on the improved efficiency of such a system and current electrical power rates, it is estimated that the original investment in a booster heat exchanger to modify an existing system would be recovered in reduced operating costs in about three years.

Figure 5A:
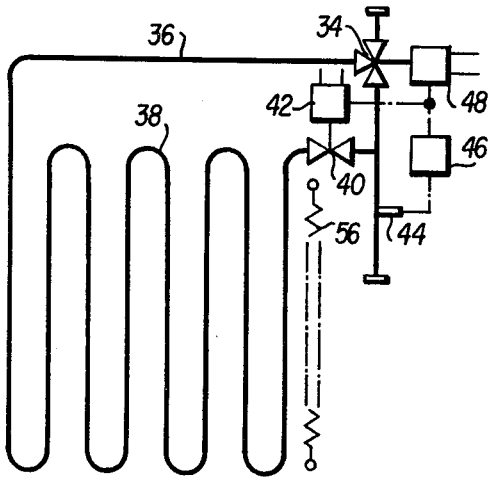
FIGS. 5A and 5B show schematic diagrams of booster heat exchangers according to the invention, suitable for modification of existing heat pump apparatus to operate in accordance with the principles of this invention.
Figure 5B:
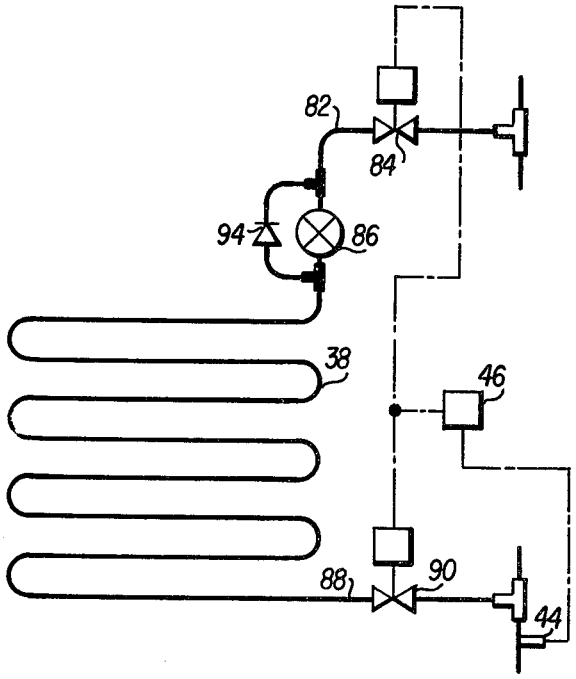

FIGS. 5A and 5B show booster heat exchangers according to the invention as configured for adaptation to existing, conventional heat pump apparatus. In FIG.

5A, three-way valve 34, conduit 36, booster heat exchanger 38, valve 40, temperature sensor 44 and controller 46, solenoid actuator 48, and associated wiring are provided as an adapter unit specially configured for installation in series with the outdoor coil of existing heat pump apparatus. In FIG. 5B, valve 84, expansion valve 86, check valve 94, booster heat exchanger 38, valve 90, temperature sensor 44 and temperature controller 46 are provided as a unit specially configured for installation in parallel with the outdoor coil of existing heat pump apparatus. Attachment flanges or similar unions are provided for simplified hook-up in the field.

Having described my invention in sufficient detail to enable those skilled in the art to make and use it, I claim:

1. Air-conditioning apparatus, comprising:

a first heat exchanger exposed to an environment to be air-conditioned;

a second heat exchanger exposed to an environment from or to which heat is to be absorbed or rejected;

refrigerant compressor means for pumping refrigerant through said apparatus, said compressor means having a suction port;

tubing means interconnecting said heat exchangers and said compressor means for permitting refrigerant flow through said apparatus;

first valve means mounted in said tubing means for directing refrigerant flow through said apparatus;

a booster heat exchanger exposed to an environment from which heat is to be absorbed during the heating mode of the apparatus and connected to said tubing means to receive refrigerant flow at a location in said tubing means upstream of said suction port and to deliver said flow to a portion of said tubing means leading to said suction port; and second valve means mounted in said tubing means for controlling flow through said booster heat exchanger as a function of temperature of said refrigerant at said suction port for connecting said booster heat exchanger to receive flow from said tubing means when said first valve means is in position to cause said apparatus to withdraw heat from said environment and for disconnecting said booster heat exchanger to prevent flow therethrough when said first valve means is in position to cause said apparatus to reject heat to said environment.

2. The apparatus of claim 1, wherein said booster heat exchanger is an ambient atmosphere heat exchanger.

3. The apparatus of claim 1, further comprising means for actuating said second valve means to permit flow into said booster heat exchanger for a limited time after said first valve means is positioned to cause said apparatus to reject heat to said environment, whereby said booster heat exchanger may be defrosted.

4. The apparatus of claim 1, wherein said booster heat exchanger is connected in series with said second heat exchanger.

5. The apparatus of claim 1, further comprising means connected to said tubing means for controlling the pressure of said refrigerant at said suction port.

6. The apparatus of claim 1, wherein said booster heat exchanger is connected in said tubing means to receive refrigerant flow at a location upstream of said first valve means when said first valve means is in position to cause said apparatus to withdraw heat from said environment.

* * * * *